US008402565B1

(12) United States Patent
Penner

(10) Patent No.: US 8,402,565 B1
(45) Date of Patent: Mar. 26, 2013

(54) ZIPPERED PANT SYSTEM

(76) Inventor: Peggy M. Penner, North Newton, KS (US)

( * ) Notice: Subject to any disclaimer, the term of this patent is extended or adjusted under 35 U.S.C. 154(b) by 30 days.

(21) Appl. No.: 12/953,846

(22) Filed: Nov. 24, 2010

(51) Int. Cl.
*A41D 1/06* (2006.01)

(52) U.S. Cl. ..... 2/227; 2/235

(58) Field of Classification Search ..... 2/83, 227, 2/114, 70, 235, 236, 219, 72, 78.1, 78.2, 2/79, 80, 228, 237, 238, 213, 218, 232; D2/742, D2/745, 712
See application file for complete search history.

(56) References Cited

U.S. PATENT DOCUMENTS 1,885,527 A * 11/1932 Luft ..... 2/227
2,032,982 A * 3/1936 Gerstman ..... 2/228
2,236,636 A * 4/1941 Young ..... 2/227
2,923,009 A * 2/1960 Cookman ..... 2/227
3,246,342 A * 4/1966 Pagano ..... 2/227
3,800,330 A * 4/1974 Bowcut ..... 2/227
3,801,986 A * 4/1974 Purdon ..... 2/69
3,879,865 A 4/1975 Kimball
4,993,077 A * 2/1991 Robison ..... 2/82
5,717,999 A 2/1998 Lurry
5,802,611 A * 9/1998 McKenzie et al. ..... 2/69
5,864,888 A 2/1999 Archer
6,477,716 B2 11/2002 Blaire
D466,676 S 12/2002 Lyden
6,978,484 B2 12/2005 Donlan et al.
D527,169 S * 8/2006 Kubler ..... D2/742
D575,028 S * 8/2008 Patton ..... D2/742
D613,038 S * 4/2010 Viola et al. ..... D2/742
D622,935 S * 9/2010 Jackson et al. ..... D2/742
D630,415 S * 1/2011 Nunn ..... D2/742
7,966,672 B1 * 6/2011 Hagerman et al. ..... 2/227
2001/0004771 A1 6/2001 Chou

* cited by examiner

*Primary Examiner* — Amy Vanatta

(57) ABSTRACT

A zippered pant system for providing a user easy access to his/her legs or knees featuring a pair of pants having a first leg, a second leg, a waist opening, and a front opening region; and a zipper disposed in at least the first leg and the second leg of the pair of pants, the zipper has a first end and a second end wherein the first end is positioned at a bottom edge of the first leg and the second leg of the pair of pants, the zipper can be unzipped upwardly. The zipper may be positioned along the inseam of the first and second leg of the pair of pants up to the middle, of the thigh.

7 Claims, 3 Drawing Sheets

ZIPPERED PANT SYSTEM

FIELD OF THE INVENTION

The present invention is directed to pants with zippers that allow easy access to various parts of the leg, for example the knee, and openings on both sides of the waist down to the groin area for access to the hip area.

BACKGROUND OF THE INVENTION

Many times, individuals with leg or knee injuries wear shorts, for example when visiting the hospital for a check up. The shorts allow the physician to easily access the individual's leg or knee. However, shorts can be uncomfortable for some, for example they may not provide adequate warmth in cold temperatures or they may show the individual's injury, which may be uncomfortable. The present invention features a zippered pant system that provides an individual (e.g. a patient) or a physician easy access to his/her legs or knees and hip area (e.g., an injury). The zippered pant system may also provide the individual an easy and quick means of dressing (e.g., the system may be easy to use over a bandage or a cast).

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

In FIGS. 1, 210*a* and 210*b* are openings on both sides of the waist for access to hips. The pant has a first leg 102 and second leg 106, and a. waist area 104 with a top waist edge 108, wherein the first leg has an first outward side 103 and an first inner side 105, wherein the second leg has a second outward side 107 and a second inner side 109. A first zipper 110 and a second zipper 111 are disposed on the first inner side 105 and second inner side 109 respectively.

DESCRIPTION OF PREFERRED EMBODIMENTS

Referring now to FIGS. 1-5, the present invention features a zippered pant system 100. The zippered pant system 100 of the present invention provides a user (e.g. a patient) easy access to his/her legs or knees or hip area. This may be particularly useful for those with leg or knee injuries or hip replacements. For example, a physician can easily and quickly access the user's (e.g., patient's) leg or knee or hip. The zippered pant system 100 may also provide the user an easy and quick means of dressing (e.g., the system 100 may be easy to use over a bandage or cast). The zipper 110 generally extends from the ankle up to the mid-thigh area (or higher or lower, depending on the size the garment, e.g., adult or child size).

Without wishing to limit the present invention to any theory or mechanism, it is believed that the zippered pant system 100 of the present invention is advantageous because it may be constructed from a material such as a light and/or casual and/or comfortable fabric (e.g., not a thick insulated fabric or necessarily a waterproof fabric), for example denim, cotton, or polyester. The light material helps with flexibility and accessibility and can provide more comfort. This also allows for creation of a versatile wardrobe. The system 100 of the present invention does not need to be constructed from heavy insulated material, which may be used in other ski-type pants or waterproof pants. The system 100 of the present invention can be constructed with light, casual, and comfortable material, which provides flexibility. The flexibility of the material helps provide access to the leg (e.g., when a patient is at a doctor's visit or physical therapy visit, etc.), allowing the leg and hip to be examined and monitored without the patient having to remove his/her pants. Laundering and maintaining the garment will be easy and convenient. And, the materials used to construct the system of the present invention allow for a variety of styles to be available. With materials such as denim, cotton, and polyester, a large wardrobe can be created. Clothing for children as well as adults can be constructed.

The garments can be customized for any type of medical condition for the leg or knee or hip.

The zippered pant system 100 of the present invention comprises a pair of pants 105 resembling a standard pair of pants well known to one of ordinary skill in the art. For example, the pair of pants 105 has a first leg and a second leg, and a waist area with a waist top edge. Openings are on either side of the waist and go down to the groin area for easy access to the hip area. In some embodiments, the pair of pants 105 has a front opening region (e.g., a front zipper, a front button system) for widening the waist area when putting on or taking off the pair of pants.

Figure 1:
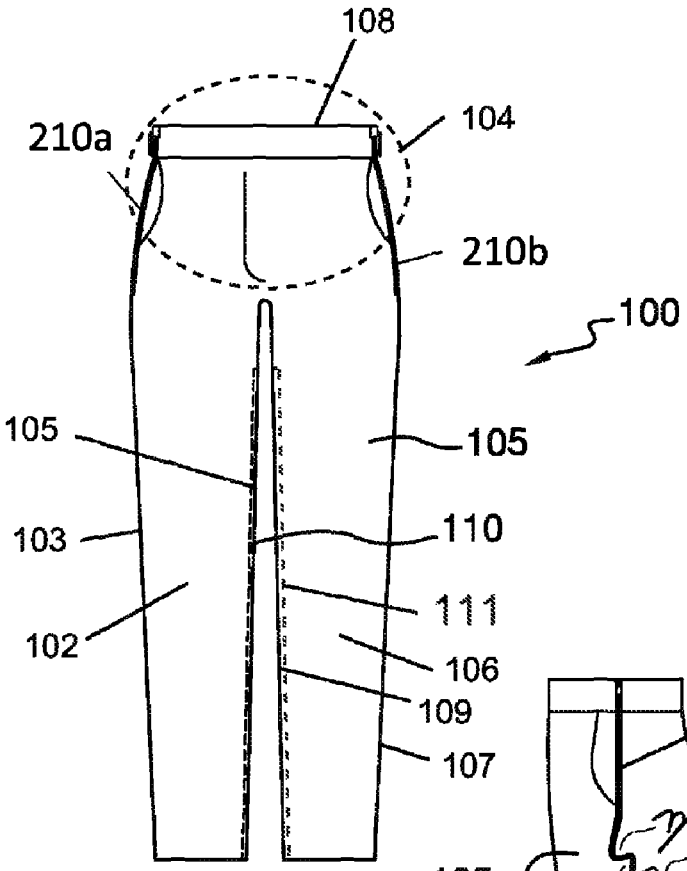
FIG. 1 is a front view of a zippered pant system of the present invention.
Figure 2:
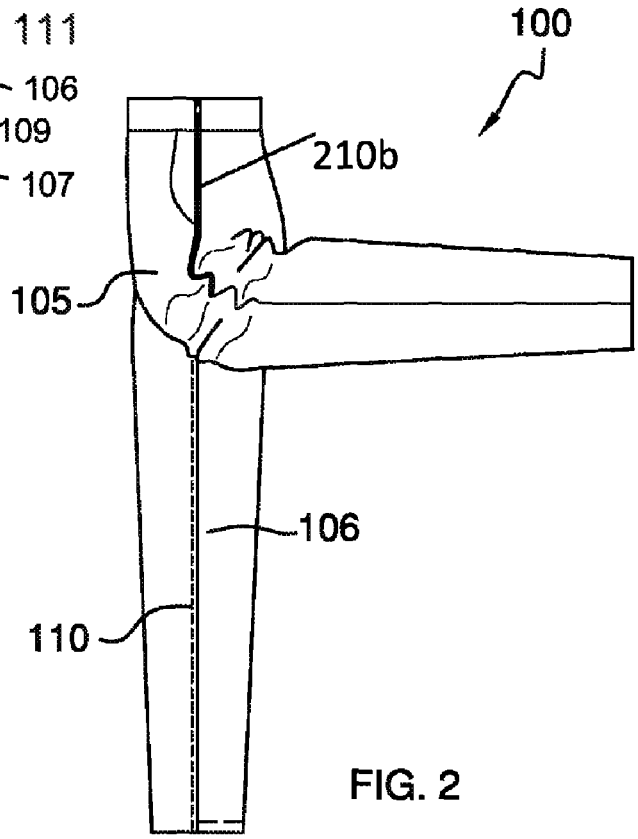
FIG. 2 is a first side view of the zippered pant system of FIG. 1, wherein the zipper is zipped.
Figure 3:
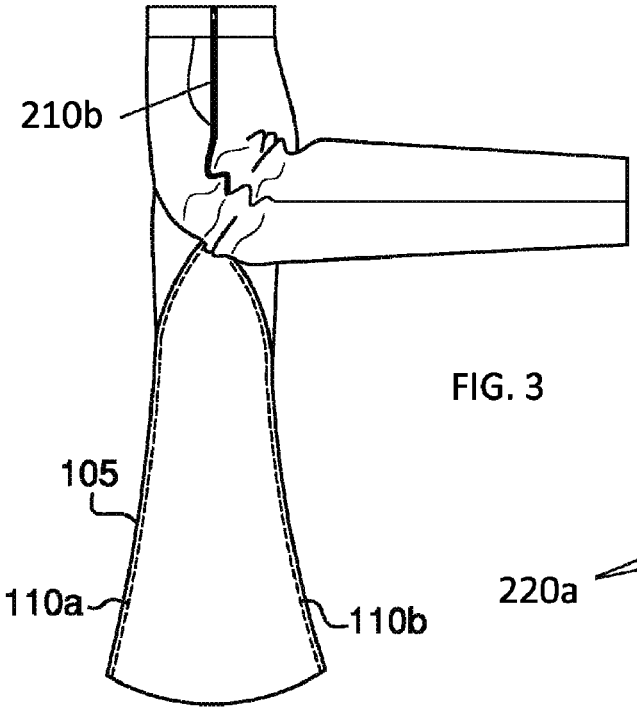
FIG. 3 is a second side view of the zippered pant system of FIG. 1, wherein the zipper is unzipped.
Figure 4:
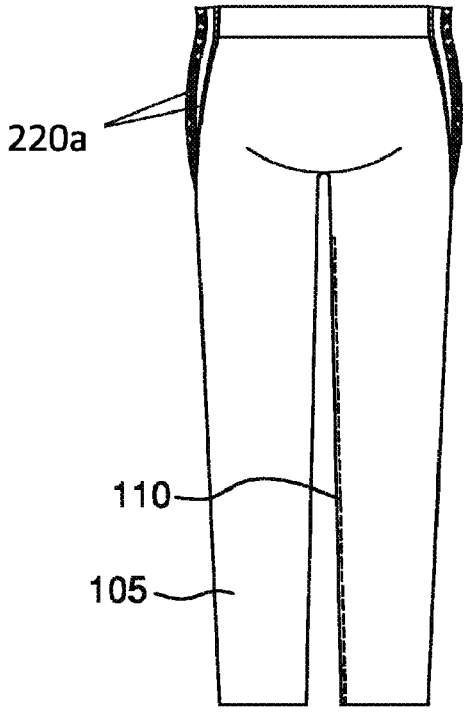
FIG. 4 is a back view of the zippered pant system of FIG. 1.
Figure 5:
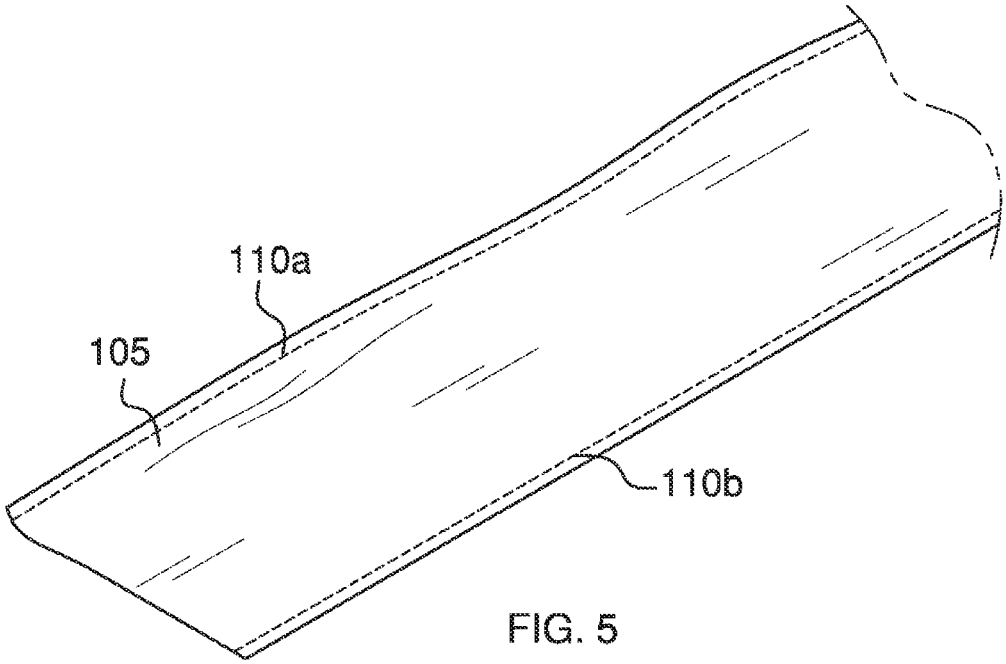
FIG. 5 is a perspective view of a portion of the zippered pant system of FIG. 4, wherein the zipper is unzipped. The zipper generally goes up to the mid-thigh area on both legs.

A zipper 110 (comprising a first half zipper 110*a* and a second half zipper 110*b*) is disposed in the first leg and/or in the second leg. The zipper 110 may be positioned in a variety of places. For example, FIG. 2 shows a zipper 110 along the inseam 106 of a pant leg. Inseams are standard parts of pants and are well known to one of ordinary skill in the art. The zipper 110 has a first end and a second end. In some embodiments, the first end is positioned at the bottom edge of the pant leg. This allows a user to unzip the zipper from the bottom edge of the pant upwardly. The zipper 110 may be constructed in a size so as to allow the pants to be unzipped from the ankle (the bottom edge of the pants 105) to the mid-thigh.

The zipper 110 may be constructed in a variety of sizes. For example, in some embodiments, the zipper 110 is between about 6 to 12 inches in length (e.g., perhaps for a child size) as measured from the first end to the second end. In some embodiments, the zipper 110 is between about 12 to 18 inches (e.g., child size) in length as measured from the first end to the second end. In some embodiments, the zipper 110 is between about 18 to 24 inches in length as measured from the first end to the second end (e.g., for adults). In some embodiments, the zipper 110 is more than about 24 inches in length as measured from the first end to the second end (e.g., ending at mid-thigh area).

As shown in FIG. 1, FIG. 2, FIG. 3, and FIG. 4, in some embodiments, a first waist zipper 210 *a* may be disposed on a first side of the waist area of the pair of pants 105 extending from the top waist edge downwardly toward the first leg of the pair of pants 105. In some embodiments, the first waist zipper 210 *a* is replaced with a hook-and-loop fastener 220 *a* or set of snaps. In some embodiments, a second waist zipper 210 *b* may be disposed on a second side of the waist area of the pair of pants 105 extending from the top waist edge downwardly toward the second leg of the pair of pants 105. In some embodiments, the second waist zipper 210 *b* is replaced with a hook-and-loop fastener 220 *a* or set of snaps. The waist zippers 210 help provide access to the user's waist and hips, which may be advantageous for accessing bandages around the hips (e.g., after a hip replacement, etc.).

As used herein, the term "about" refers to plus or minus 10% of the referenced number. For example, an embodiment wherein the zipper 110 is about 20 inches in length includes a zipper 110 that is between 18 and 22 inches in length. The zipper 110 can be up to 25 inches, depending on the size of the garment, for example.

The following the disclosures of the following U.S. Patents are incorporated in their entirety by reference herein: U.S. Pat. No. 5,717,999; U.S. Pat. No. 6,978,484; U.S. Pat. No. 5,864,888; U.S. Pat. No. 3,879,865; U.S. Pat. No. 6,477,716; U.S. patent application Ser. No. 2001/0004771.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is;

1. A zippered pant system (100) comprising:

(a) a pair of pants having a first leg (102), a second leg (106), and a waist area (104) with a top waist edge (108), wherein the first leg has a first outward side (103) and a first inner side (105), wherein the second leg has a second outward side (107) and a second inner side (109);

(b) a first zipper (110) disposed in the first leg (102) on the first inner side (105) and a second zipper (111) disposed in the second leg (106) on the second inner side (109) of the pair of pants, each zipper has a first end and a second end wherein the first end is positioned at a bottom edge of the first leg and the second leg of the pair of pants, respectively, wherein the second end is positioned at a mid-thigh area of the first leg and the second leg of the pair of pants, respectively, wherein the first zipper (110) and second zipper (111) can be unzipped upwardly to the mid-thigh area; and (c) a first waist zipper (210*a*) disposed on a first side of the waist area of the pair of pants extending from the top waist edge downwardly to a groin area for easy access to hip areas, and a second waist zipper (210*b*) disposed on a second side of the waist area of the pair of pants extending from the top waist edge (108) downwardly to a groin area for easy access to hip areas.

2. The zippered pant system of claim 1, wherein the first zipper or second zipper is positioned along an inseam of the first leg and the second leg.

3. The zippered pant system of claim 1, wherein the first zipper or second zipper is between about 24 to 25 inches in length as measured from the first end to the second end.

4. The zippered pant system of claim 1, wherein the first zipper or second zipper is between about 12 to 18 inches in length as measured from the first end to the second end.

5. The zippered pant system of claim 1, wherein the first zipper or second zipper is about 24 inches in length as measured from the first end to the second end.

6. The zippered pant system of claim 1, wherein the pair of pants is constructed from a material comprising denim, cotton, polyester, or a combination thereof.

7. A zippered pant system (100) consisting of:

(a) a pair of pants having a first leg (102), a second leg (106), and a waist area (104) with a top waist edge (108), wherein the first leg has a first outward side (103) and a first inner side (105), wherein the second leg has a second outward side (107 and a second inner side (109);

(b) a first zipper (110) disposed in the first leg (102) on the first inner side (105) and a second zipper (111) disposed in the second leg (106) on the second inner side (109) of the pair of pants, each zipper has a first end and a second end wherein the first end is positioned at a bottom edge of the first leg and the second leg of the pair of pants, respectively, wherein the second end is positioned at a mid-thigh area of the first leg and the second leg of the pair of pants, respectively, wherein the first zipper (110) and second zipper (111) can be unzipped upwardly to the mid-thigh area; and (c) a first waist zipper (210*a*) disposed on a first side of the waist area of the pair of pants extending from the top waist edge downwardly to a groin area for easy access to hip areas, and a second waist zipper (210*b*) disposed on a second side of the waist area of the pair of pants extending from the top waist edge (108) downwardly to a groin area for easy access to hip areas.

* * * * *